United States Patent [19]

Makosch

[11] 4,397,237

[45] Aug. 9, 1983

[54] ROLLER TRAIN STRUCTURE FOR USE WITH PRINTING MACHINE

[75] Inventor: Manfred Makosch, Königsbrunn, Fed. Rep. of Germany

[73] Assignee: M.A.N.-Roland Druckmaschinen Aktiengesellschaft, Augsburg, Fed. Rep. of Germany

[21] Appl. No.: 353,608

[22] Filed: Mar. 1, 1982

[30] Foreign Application Priority Data

Mar. 31, 1981 [DE] Fed. Rep. of Germany ..... 3112745

[51] Int. Cl.[3] ..... B41F 31/32

[52] U.S. Cl. ..... 101/352; 101/247; 118/262

[58] Field of Search ..... 101/352, 349, 351, 350, 101/209, 247, 148, 139, 140, 143, 144, 145, 182, 184, 185; 118/262

[56] References Cited

U.S. PATENT DOCUMENTS

| | | | |
|---|---|---|---|
| 2,162,812 | 6/1939 | Harrold et al. | 101/351 |
| 2,546,793 | 3/1951 | Sodomka | 101/352 X |
| 2,751,843 | 6/1956 | Faeber | 101/349 |
| 3,041,966 | 7/1962 | Polglase, Jr. | 101/352 X |
| 3,168,037 | 2/1965 | Dahlgren | 101/148 |
| 3,404,625 | 10/1968 | White | 101/351 X |
| 3,448,686 | 6/1969 | Bohman | 101/349 |
| 3,491,686 | 1/1970 | Zurick | 101/352 |
| 3,986,452 | 10/1976 | Dahlgren | 101/148 |

FOREIGN PATENT DOCUMENTS

| | | | |
|---|---|---|---|
| 1129446 | 5/1962 | Fed. Rep. of Germany | 101/352 |
| 1062957 | 3/1967 | United Kingdom | 101/352 |
| 1126097 | 9/1968 | United Kingdom | 101/352 |

*Primary Examiner*—Edgar S. Burr
*Assistant Examiner*—Moshe I. Cohen
*Attorney, Agent, or Firm*—Frishauf, Holtz, Goodman & Woodward

[57] ABSTRACT

To provide access to an ink application roller (11) located circumferentially about the plate cylinder (1) and behind another ink application roller (10), the inner one (11) of the ink application rollers is secured to an inner support plate (14) which is pivotable together with an outer support plate (13) about a bushing of a bearing (21) retaining a milling roller of the ink train, the outer plate additionally supporting other ink distribution rollers (7, 8) receiving ink from an ink supply roller (3), so that the entire roller train (B) formed by the ink distribution rollers (7, 8) and the inner one (11) of the ink application rollers can be tipped out of engagement position to thereby provide access to those rollers which are located behind the milling roller (9). The system is particularly applicable for a double-parallel ink train arrangement in which the respective ink distribution rollers and application rollers are physically located behind another ink train (A) formed by another roller system (4, 5, 6).

5 Claims, 2 Drawing Figures

ROLLER TRAIN STRUCTURE FOR USE WITH PRINTING MACHINE

Figure 1:
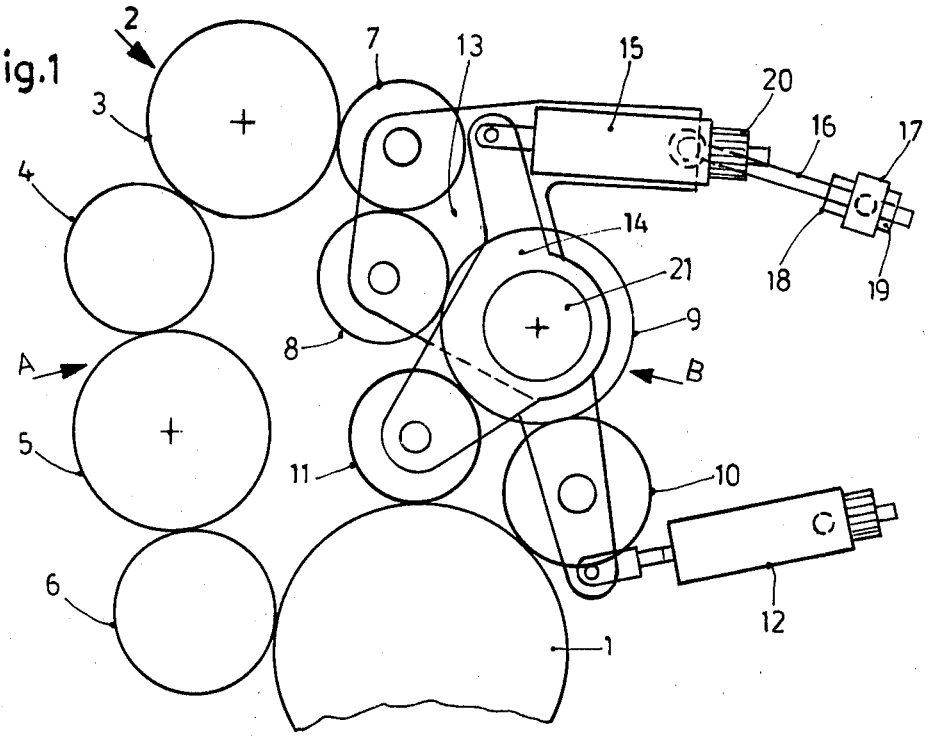

The present invention relates to a roller train structure which can be applied against a plate cylinder of an offset printing machine or a raised-letter press printing machine, and more particularly to a holder structure suitable for an ink roller train.

BACKGROUND

Roller trains, particularly to distribute ink in the inking system of a printing machine, frequently use a plurality of rollers which are so arranged that some rollers hide other rollers therebeneath, so that access to the inner ones of the rollers is impaired. In some structures, it is desirable to permit movement of rollers towards or away from another engaged roller. British Pat. No. 1,422,421 describes an inking system in which a plate cylinder is inked by a plurality of ink application rollers. The ink application rollers, in turn, receive ink over two roller trains. To permit change-over, or to engage and disengage the inking system, one further roller can be pivoted or tipped about a roller which is journaled in fixed bearings, maintained in a predetermined position in the frame. Such roller trains have disadvantages in that it is difficult to replace certain rollers without disassembling the entire roller train, and particularly without disassembling the rollers which hide the inner ones, or the ones covered thereby. Thus, maintenance and/or exchange of some of the rollers beneath outer ones is difficult, time-consuming, and expensive.

THE INVENTION

It is an object to provide a roller train which permits disassembly or adjustment of any one of the rollers thereof, even though the particular roller may be hidden beneath or behind another one, and without disassembling the outer or covering roller, or roller set or group.

Briefly, a first bearing plate is provided, secured to an outer roller which is maintained in position. The first bearing plate can be pivoted or tilted or rocked about the axis of rotation of this outer roller. At least one roller is retained in the first bearing plate, and in surface engagement with the outermost roller. The bearing plate, further, retains a second bearing plate thereon, which is relatively rotatable with respect to the first one, the second bearing plate supporting at least one inner roller. Positioning control elements are provided secured to the first bearing plate and defining the position of the second bearing plate, and the relative position of the roller or rollers secured thereto. The first bearing plate also has positioning elements associated therewith, permitting rocking or pivoting of the first bearing plate about the axis of rotation of the outermost roller to such an extent that, thereby, the inner rollers which are secured to the second bearing plate become accessible.

The roller train has the advantage that those rollers which, in normal operation, are not readily accessible still can be removed or reached without substantial disassembly time, since it is no longer necessary to disassemble the outer rollers in order to reach, for example, an inner one for replacement because of wear, or for maintenance, or for adjustment. Further, the system is particularly simple to service and to adjust since the inner rollers can be relatively adjusted in their position without requiring disassembly of the outer rollers.

The system can be used in inking systems both for offset as well as for raised-letter presses which have dual or multiple path ink trains. The system further has the advantage that the pivoting arrangement can be easily adjusted by pivoting against a stop so that the positioning of the rollers, after service work, for example on the inner rollers, and after re-positioning, will be retained as controlled, without renewed re-adjustment of the position of outer rollers, which have been tipped or pivoted out of their normal position. Placement of the outer rollers with respect to other rollers or cylinders of the system which have bearings fixed in a frame thus is simple.

DRAWINGS

Figure 2:
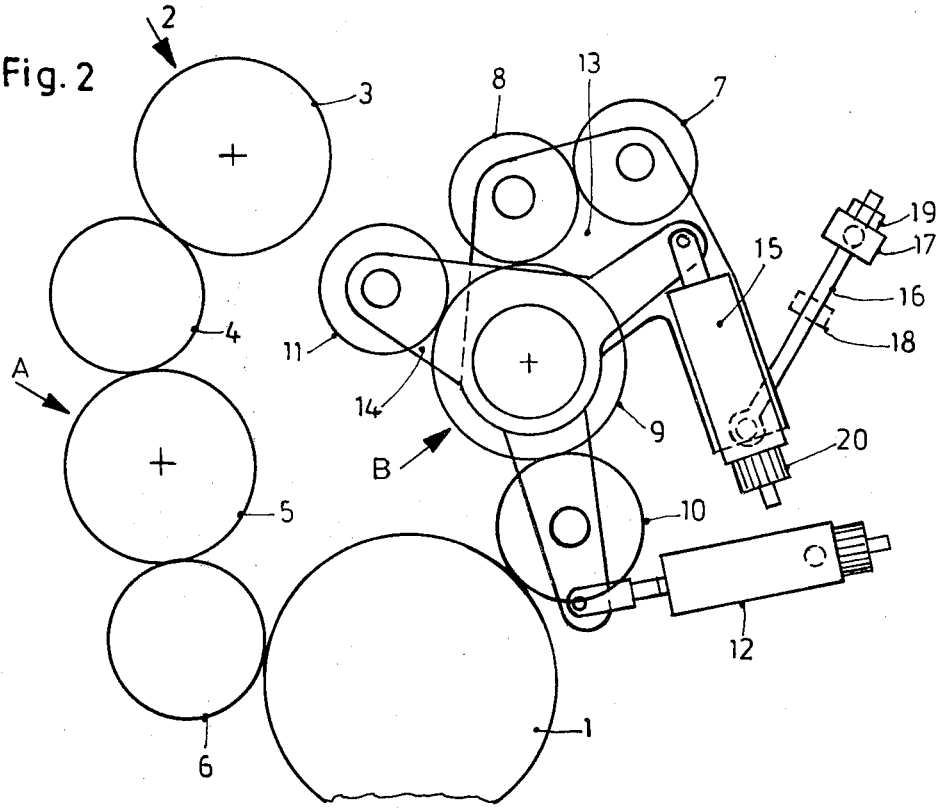

FIG. 1 is a schematic side view of a portion of the roller train of an inking system, illustrating those parts which are close to the plate cylinder of a rotary offset printing machine, with the rollers in engaged position; and FIG. 2 illustrates the system of FIG. 1 with the rollers in disengaged or removed position.

The inking system 2 supplies ink to a plate cylinder 1 by applying ink from an ink trough (not shown) and, for example, a ductor roller which supplies the ink necessary for inking of the plate cylinder. Ductor or film-forming or milling rollers may be used in accordance with any known and suitable structure. The ink supply system itself is generally known, and thus not shown in FIGS. 1 and 2. The ink derived from the ink trough is applied to an ink roller 3 and then applied over distribution rollers 4 and 5 to an application roller 6 which provides ink for the plate cylinder 1. This ink train is labeled ink train A. As shown, the ink train is in continuous rolling engagement with the plate cylinder 1.

A parallel ink train B is in rolling contact with the ink roller 3. Ink roller 3 may be a milling roller, and ink is applied to further ink rollers 7 and 8, and from there on a milling roller 9. Two secondary application rollers 10, 11 are in engagement with the milling roller 9 which, together with the application roller 6, provides for uniform inking of the plate cylinder 1.

The secondary ink application roller 11 is positioned inwardly of the rollers 7, 8, 9 and 10, and is therefore hidden behind the rollers. Roller 11 may be termed an inner roller, and access thereto is impeded by the other rollers as well as by the milling roller 9. Thus, the secondary roller 11 cannot be serviced or exchanged or adjusted without removing the outer rollers 8, 9, 10 and, preferably, also roller 7, which together impede access to the roller 11. Roller 10, of course, can readily be exchanged and serviced, and its adjustment position easily controlled by an adjustment element 12, for example a pneumatic or hydraulic cylinder-piston arrangement, which permits engagement and disengagement of the cylinder 10 with the surface of the plate cylinder 1.

In accordance with the invention, the milling roller 9 is secured in bearings 21 in the side walls of the machine (not shown), and thus fixed in position. A first, or outer plate 13 is provided, rotatable or pivotable about the bearing bushings of the milling roller 9. The outer, or first bearing plate 13 is used to receive the bearings of the rollers 7 and 8. Additionally, plate 13 supports a second, or inner bearing plate 14. The second or inner bearing plate 14 is rotatable relative to the outer or first plate 13 about the axis of rotation of the milling roller 9, for example about the outer bearing bushing thereof.

A similar arrangement, the mirror image of that described, is located at the other axial ends of the rollers. The bearing plate 14, located at the end faces of the milling roller 9 receive the bearings for the secondary ink application roller 11. To properly position the secondary ink application roller 11 in the desired location on the plate cylinder, bearing plate 13 has a positioning element 15 associated therewith, for example a hydraulic or pneumatic piston-cylinder positioning element secured on plate 13, which permits lifting the bearing plate 14 and with it the secondary application roller 11 off the plate cylinder 1 or, alternatively, in engagement therewith; positioned movement of the positioning element 15 coupled to the inner bearing plate 14 is independent of rocking or pivoting movement of the outer bearing plate 13 which carries element 15.

The bearing plate 13 can be pivoted together with the bearing plate 14 by a further positioning element formed by components 16, 17, 18, 19 to pivot the outer bearing plate 13 in clockwise direction about the milling roller 9 so that, in a limiting position, the bearing roller 11, and its adjustment position, is readily accessible—see FIG. 2. This permits, for example, removal of servicing of the roller 11 without the necessity of disassembly of any one of the other rollers of the system.

The locating arrangement for the outer, or first plate 13 includes a guide rod 16 which is pivotably linked to the bearing plate 13 with one end thereof. The other end of the guide rod 16 is threaded and is guided in a rotatable holder 17 which is fixed in position, for example on the frame (not shown) of the machine. Adjustment or positioning nuts 18, 19 are threaded on the guide rod 16 at both sides of the holder 17 so that the position of the guide rod 16 can be predetermined.

Operation: To carry out maintenance work, nut 19 is loosened and, upon rotation of holder 17, the first or outer plate 13, and with it the inner plate 14, is rocked from the position shown in FIG. 1 to the position shown in FIG. 2, where the secondary ink application roller 11 is readily accessible. After carrying out the necessary maintenance work on the secondary ink application roller 11, for example exchange, finishing of the surface thereof, or the like, and while the roller train is in the position of FIG. 2, the position of the adjustment nut 19 is re-established. This insures that the roller 7 will, upon change-over to the position of FIG. 1, have the same distance or engagement pressure with respect to roller 3 which it had prior to pivoting the entire system from the position of FIG. 1 to the position of FIG. 2.

Individual fine adjustment of the ink application roller 11 is carried out by an adjustment button 20, associated with the, preferably pneumatic, lifting or disengagement device 15. As can be seen in FIGS. 1 and 2, the position of the secondary ink application roller 11 with respect to the plate cylinder, once determined by the adjustment knob 20, is not changed when the plates are pivoted about the bearing 21 of the milling roller 9. This substantially simplifies adjustment of the secondary ink application roller 11, and hence results in substantial saving of time. Further, adjustment or maintenance work on the roller 8 of the roller train B is simplified since this roller also becomes freely accessible when the roller train is pivoted or tipped into the position shown in FIG. 2. Roller 8, likewise, can be readily exchanged or its radial position adjusted, as well known, for example by an eccentrically located bearing or the like.

Roller train A has been shown in its simplest standard form; it, of course, can also be constructed similarly to the roller train B, with dual support plates, merely in form of a right-for-left reversed mirror image.

Various changes and modifications may be made within the scope of the inventive concept.

I claim:

1. In combination with a printing machine having a plate cylinder (1), an ink train system having an ink distribution roller means (7, 8);

two application rollers (10, 11) positioned in circumferentially offset location about the circumference of the plate cylinder, whereby one roller (11) will be located behind the other roller and thereby form an inner roller (11) of the ink train system;

an ink transfer roller (9) in engagement with both said application rollers (10, 11), and further in engagement with the ink distribution roller means (7, 8);

and bearing means (21) locating the ink transfer roller in a fixed position on a frame of the machine, comprising, a first outer support plate (13) pivotally mounted to pivot about the axis of rotation of said bearing means (21), said first outer support plate securing thereon the ink distribution roller means (7, 8);

a second, inner support plate (14) pivotally mounted to pivot about the axis of rotation of said bearing means independently of pivoting movement of said outer support plate, said second, inner support plate securing thereon the inner roller (11);

first operating means (16–19) coupled to the first outer support plate (13) to effect and control pivoting movement thereof about the axis of rotation of the transfer roller (9);

and means to render the inner application roller (11) accessible from behind the outer application roller (10) including second operating means (15, 20) coupled to the second, inner support plate (14) and secured to the first outer support plate (13) to control relative positioning of the inner roller (11) with respect to the plate cylinder (1) while permitting rolling movement about the circumference of the transfer roller (9) upon pivoting or tipping the first, outer plate (13) about the axis of rotation of the transfer roller under command of said first operating means.

2. System according to claim 1, wherein said ink train system further includes an ink supply roller (3) and roller elements (4, 5, 6) applying ink from the ink supply roller (3) to the plate cylinder;

and wherein said ink distribution roller means (7, 8) comprises an ink distribution roller (7) in engagement with said distribution roller (3) when said outer plate (13) is pivoted for engagement position of the respective ink distribution roller (7) and said ink supply roller (3) with each other.

3. System according to claim 2 wherein said transfer roller (9) comprises a milling roller.

4. System according to claim 1, wherein said ink train system includes an ink supply roller (3);

and wherein said first operating means comprises adjustable means (17, 18, 19) positioning the ink distribution roller means (7, 8) with respect to said ink supply roller (3) in predetermined location.

5. System according to claim 4, wherein said adjustable means comprises a stop means (18, 19) cooperating with a fixed stop (17) located on the frame of the machine to position the rollers moved upon pivoting movement of the outer plate with respect to the ink supply roller and said plate cylinder in predetermined, adjusted location.

* * * * *